United States Patent [19]

Zinck

[11] Patent Number: 4,496,007

[45] Date of Patent: Jan. 29, 1985

[54] COMPRESSED-AIR PILE-DRIVER

[76] Inventor: Eugen Zinck, Hüffelsheimer Str. 2, 6550 Bad Kreuznach, Fed. Rep. of Germany

[21] Appl. No.: 363,158

[22] Filed: Mar. 29, 1982

[30] Foreign Application Priority Data

Mar. 28, 1981 [DE] Fed. Rep. of Germany ..... 3112463
Sep. 25, 1981 [DE] Fed. Rep. of Germany ..... 3138130

[51] Int. Cl.[3] ..... B25D 9/00; E21B 1/00

[52] U.S. Cl. ..... 173/127; 173/134; 173/135; 91/299; 91/317

[58] Field of Search ..... 173/127, 134, 135; 91/299, 317

[56] References Cited

U.S. PATENT DOCUMENTS 2,953,117 9/1960 Wandel et al. ..... 173/127 X
3,895,680 7/1975 Cook ..... 173/127 X

FOREIGN PATENT DOCUMENTS 0278374 2/1913 German Democratic Rep. .
0379665 9/1920 German Democratic Rep. .
0321674 11/1929 United Kingdom ..... 91/299

*Primary Examiner*—Paul A. Bell
*Assistant Examiner*—Taylor J. Ross
*Attorney, Agent, or Firm*—Becker & Becker, Inc.

[57] ABSTRACT

A compressed-air pile-driver, especially for axially insertable tools, including a ram arranged in a housing. The interior of the housing is divided by the ram respectively into an upper compression or expansion chamber and a lower compression or expansion chamber, which can each be alternately connected to a compressed-air source via air connection pipes and a control valve, with each having an air-outlet orifice opened alternately by the ram. In the upper expansion chamber, a pressure chamber, into which the upper air connection pipe of the upper expansion chamber opens, is divided off by an intermediate plate which is approximately parallel to the end face of the ram. Located in the intermediate plate is at least one orifice which connects the pressure chamber to the upper expansion chamber, and which is closed in a leak-proof manner by the ram in its upper dead-center position, the ram additionally being retained firmly in its upper dead-center position by a retaining device. Only when a pressure overcoming the retaining force of the retaining device is built up in the air-inlet orifice is the ram thrown explosively downwards, absorbing high energy in the course of short acceleration paths. The housing of the compressed-air pile-driver is injection-molded from plastic, preferably polycarbonate resins, in order to save weight and cost.

18 Claims, 6 Drawing Figures

81
16
41
25
25
15
8
2
26
19
59
4
9
13
18
18
58
1A
10
40
68
5
7
40
39
14
38
23
11
6
21
21
17
69
27
3
80
61
61
54
3
35
65
50
65
35
36
36
34
34
33
33
20
24
66
49
70
30
57
1B
22
37
22
56
29
42
4
32
43
28
31
77
47
12

COMPRESSED-AIR PILE-DRIVER

The present invention relates to a pneumatic or compressed-air pile-driver, especially for axially insertable tools, comprising a ram which is arranged in a housing and which divides the interior of the housing into an upper compression or expansion chamber and a lower compression or expansion chamber, the chambers being alternately connectable to a compressed-air source via air connection pipes and a control valve, with each chamber having an air-outlet orifice opened alternately by the ram.

Pile drivers of this type, also commonly called steam hammers, are known, for example, from German Patent Specification Nos. 379,665 dated Aug. 27, 1923 and 278,374 dated Sept. 25, 1914. The air-outlet orifices are arranged as radial bores in the housing wall, and are opened alternately by the ram when it runs over them. The ram has an annular gap towards the inner machined wall of the high-tensile steel housing; thus, through the gap, there is caused a considerable loss of the compressed air fed into an expansion chamber, so that a compressed-air hammer designed in this way has not only a consumption of enormous quantities of air, but also a relatively low efficiency, since a considerable unused volume of compressed air flows out through the annular gaps.

Furthermore, when the upper expansion chamber is under pressure, the ram is accelerated downwards, and because of the increasing speed of the ram, the compressed air lags behind the ram, since it has to compensate the pressure drop occurring as a result of the movement of the ram. Only a small part of the energy of the compressed air supplied can therefore be converted into acceleration force. Consequently, to achieve a high impact force, long acceleration paths of the ram, and therefore long and voluminous expansion chambers, are required, thus making it necessary to use high-power compressors. Thus, motors of approximately 30 kW are needed to drive the compressor.

The known compressed-air pile-drivers are very long, which makes them very heavy and cumbersome because of the steel housing, so that their possibilities of use are limited. Moreover, a tool of this type is very expensive because of the high consumption of high-grade steel, and because of the many surfaces to be machined.

The present invention is based on an object that includes the following factors: to lower the air consumption of a compressed-air pile-driver, to increase its impact force while at the same time reducing the production costs, and to lessen its overall length and its weight.

This object, and other objects and advantages of the present invention, will appear more clearly from the following specification in connection with the accompanying drawings, in which.

Figure 1:
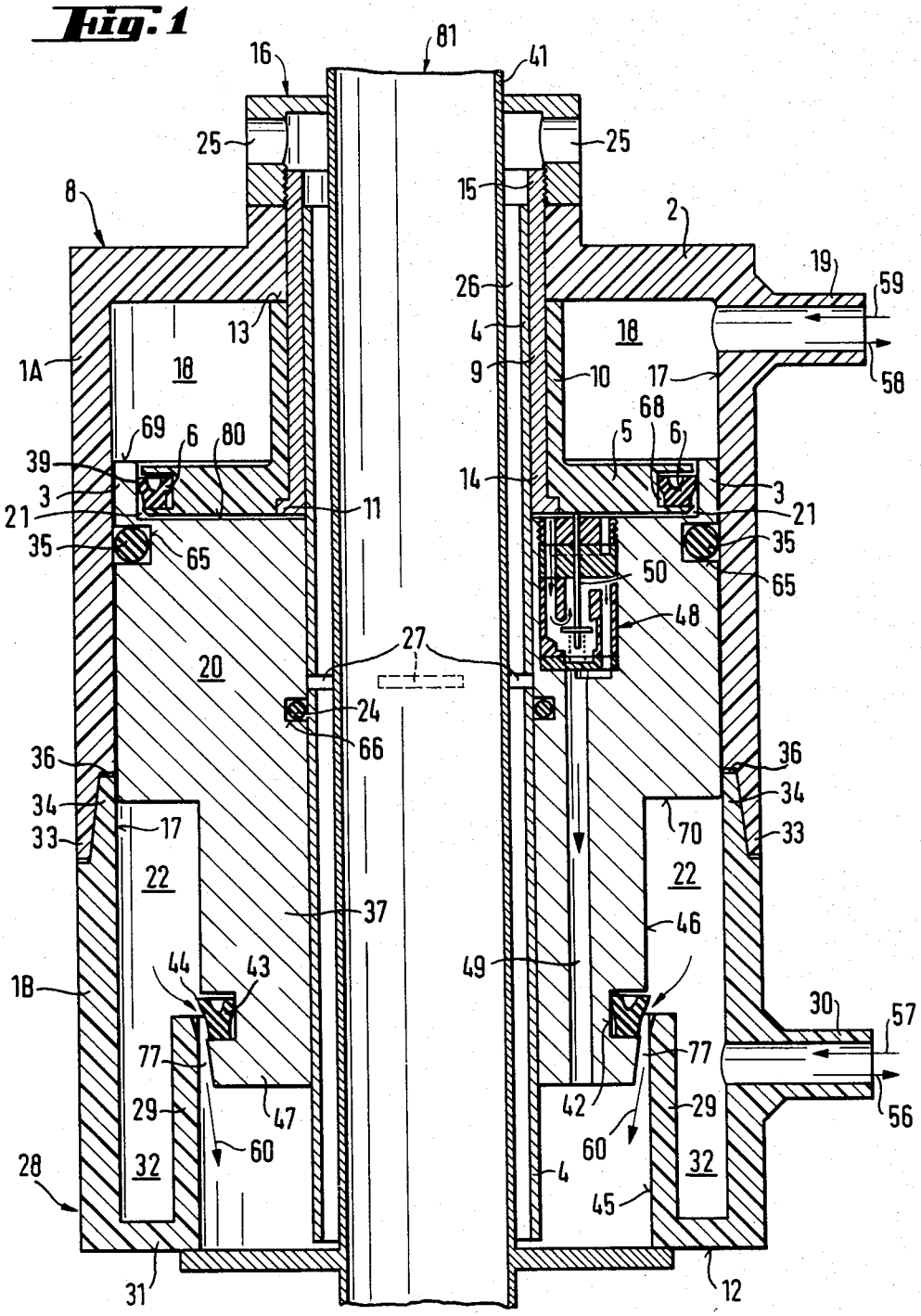
FIG. 1 shows a section through one embodiment of an inventive compressed-air pile-driver, with the ram retained in the upper dead-center position.

The compressed-air pile-driver of the present invention is characterized primarily in that, in the upper expansion chamber, a pressure chamber, into which the air connection pipe of the upper expansion chamber opens, is divided off by an intermediate plate which is approximately parallel to the end face of the ram; and in that, located in the intermediate plate, is at least one axial orifice which extends from the pressure chamber to the upper expansion chamber, and which is closed in a leak-proof manner by the ram in its upper dead-center position; the ram additionally is firmly retained axially in the upper dead-center position by a retaining device.

Because of the retaining device provided, the ram is retained in its upper dead-center position, in which it closes the air-inlet orifice in a leak-proof manner. The compressed air fed to the upper pressure chamber can therefore exert a force on the ram only via the cross-sectional face of the air-inlet orifice. Only when this force exceeds the retaining force of the retaining device is the ram moved downwards. As a result of this arrangement, an air pressure exceeding the compressor pressure will build up in the pressure chamber, so that, when the release pressure is reached at which the force of the retaining device is overcome, the compressed air of the pressure chamber can suddenly flow into the expansion chamber, acting on the entire end face of the ram and accelerating the latter explosively downwards. The acceleration of the ram is factors greater than in the state of the art, so that the same or greater impact energy can be imparted to the ram over considerably shorter acceleration paths. The result of this is that because of the shorter acceleration paths, the overall length can be reduced considerably, thus noticeably lessening the weight of the compressed-air pile-driver. Since, because of the shorter acceleration paths, the expansion and compression chambers controlling the ram are also smaller, the air consumption of the compressed-air pile-driver is noticeably reduced, so that compressors with a drive power of only 3 kW are sufficient. The operating costs of the compressed-air pile-driver of the invention are therefore very low.

Advantageously, the retaining device is formed by an axial extension of the ram which penetrates into the air-inlet orifice of the intermediate plate, the extension interacting with a gasket which is located in the intermediate plate and which, for secure air-tight contact, rests against the extension of the ram under radial pressure and thus exerts, at the same time, a radial clamping force which retains the ram in its upper dead-center position. For the sake of simplicity, the axial extension is designed as an annular extension, and the air-inlet orifice is designed as an annular gap. The pressure rising in the pressure chamber therefore acts only on that end face of the ram located in the air-inlet orifice of the intermediate plate. The ram is moved downwards only when the pressure occurring in the pressure chamber can overcome the clamping force of the gasket in the air-inlet orifice; after the air-inlet orifice has been opened, the pressure present spreads explosively in the upper expansion chamber and throws the ram downwards with enormous acceleration, as a result of which an enormous impact force is achieved with a very short travel.

In an advantageous development of the invention, the air-inlet orifice is provided as an annular gap between the outer edge of the intermediate plate and the housing, and a sealing ring needs to be arranged only in the outer edge of the intermediate plate, since the sealing-off of the annular projection from the housing can be effected by a gasket located in a peripheral groove on the outer face of the ram.

By means of changes in construction, the end face of the ram effective in the air-inlet orifice can be selected as desired, and for this purpose the starting pressure of the pile-driver and the clamping force in the annular gap can also be varied as desired. As a retaining device, it is also possible to provide magnets which are embedded in that end face of the ram which faces a magnetic intermediate plate.

In a further embodiment of the invention, the housing of the compressed-air pile-driver is injection-molded from plastic, preferably from polycarbonate. As a result, a substantial reduction in weight and a considerably more economical production are achieved. The heavy housings made of high-grade steel, which are expensive to machine, are done away with entirely. The inner face of the housing made of plastic does not need to be machined further because of the method of production. Since polycarbonates are transparent in the normal temperature range, a visual check of the moving parts of the compressed-air pile-driver is possible at any time. Particularly the O-rings sealing off the annular gaps can be checked easily for wear, without the compressed-air pile-driver having to be dismantled.

In a further design of the invention, there is located in that end face of the ram facing the intermediate plate, a relief valve via which, together with a relieving bore in the ram, the upper expansion chamber can be connected to the outside air in the region of the upper dead-center position of the ram.

The control valve of the compressed-air pile-driver, which is designed as a flutter valve, is preferably located outside the housing of the compressed-air pile-driver, and can therefore be exchanged simply at any time. In an advantageous embodiment, the control valve comprises two identical halves which are preferably injection-molded from plastic and, in their sides facing one another, have annular channels into which the necessary air connection pipes open. Furthermore, in the annular space formed by the annular channels, there may be an injection-molded valve insert which comprises two parts and which guides a valve plate interacting with the mouths, designed as valve seats, of the housing connection pipes. Because the construction comprises two equal halves, the production of a control valve of this type is especially economical.

Further features of the present invention may comprise a guide tube passing centrally and in a largely air-tight manner through the housing, the intermediate plate, and the ram, with the guide tube terminating approximately at the lower end face of the housing and being fastened in the bottom of the housing.

The shaft of a tool or of a probe tube may be inserted into the guide tube at a radial distance from the wall of the latter, there being arranged, on the bottom of the housing, a spacer which has a central bore corresponding to the diameter of the shaft, and which has air-channels through which the outgoing air, flowing between the guide tube and the shaft, escapes into the outside air.

Provided in the guide tube may be axially very narrow air outlets, for example peripheral slits, for sudden relief of the expansion chamber, the air outlets being arranged in such a way that, approximately in the lower dead-center position of the ram, they are opened by the ram.

The housing may be made of polycarbonate resins, such as Makrolon, preferably by injection-molding, for the purpose of economical production, and may be designed in two parts, including a cup-shaped upper cylinder half with a bottom preferably molded integrally therewith, and a lower cylinder half arranged in the same axis, with that end of the lower cylinder half facing away from the upper cylinder half being formed by an inner coaxial cylindrical portion which is connected to the lower cylinder half via an annular bottom which forms the lower end face of the housing and which delimits an annular space open axially towards the interior of the housing. The cylinder halves may have the same diameter and the same wall thickness, with those ends of the cylinder halves which face one another axially overlapping one another, making a seal.

The ram may be sealed off in an air-tight manner in the housing by sealing rings such as, for example, O-rings, respectively located in peripheral grooves.

The ram may have a portion of reduced diameter with a grooved ring which is located in its end region in a peripheral groove thereof, with a sealing edge of said ring projecting beyond the peripheral face of the portion to rest against the inner face of the cylindrical portion, the free end of the portion of reduced diameter tapering slightly conically underneath the grooved ring and forming an air-outlet channel. In the upper dead-center position of the ram, the grooved ring may be extended out of the cylindrical portion, at least with its sealing lip, with notches for the unimpeded outflow of air advantageously being provided in the overrun cylinder edge.

Referring now to the drawings in detail, the housing 8 of the compressed-air pile-driver is made of a plastic which can be injection-molded, preferably a polycarbonate such as Makrolon (registered trademark). It essentially comprises a cup-shaped upper cylinder half 1A, with a head or bottom 2 preferably molded integrally therewith, and a lower cylinder half 1B arranged in the same axis as the upper half. The cylinder halves 1A and 1B have the same diameter and approximately the same wall thickness, and overlap one another axially at those ends 33, 34 which face one another, so that when they are joined together, it is guaranteed that the two cylinder halves will be arranged in the same axis. For this purpose, the ends 33, 34 are made axially wedge-shaped, as a result of which, after joining together, there is no projection to impede operation either on the inner face 17 or on the outer face of the housing 8.

The end 28 of the lower cylinder half 1B facing away from the upper cylinder half 1A has an inner, coaxially arranged cylindrical portion 29. This is connected to the lower cylinder half 1B via an annular bottom 31 which, at the same time, forms the lower end face 12 of the housing 8. An annular space 32, open axially towards the housing interior, is delimited by the cylindrical portion 29, the cylinder half 1B, and the annular bottom 31.

An air connection pipe 19, 30 is injection-molded on the housing in the upper and lower regions respectively, and leads respectively to a housing connection pipe 86, 87 of a control valve 83 (FIG. 4) which is located on the outside and which supplies compressed air alternately via the upper or the lower air connection pipe 19 and 30 respectively to the compressed-air pile-driver.

The upper air connection pipe 19 opens into a pressure chamber 18 which is separated from the remaining inner space of the housing 8 by an intermediate plate 5. A retaining sleeve 9 passes centrally through the intermediate plate 5, and at its lower end 14 engages under the intermediate plate 5 by means of a shoulder 11 directed radially outwards. The shoulder 11 is preferably embedded in the end face 23 of the intermediate plate 5, so that the end face 23 turned towards the ram 20 is planar.

The retaining sleeve 9 is surrounded flush by a sleeve extension 10 of the intermediate plate 5, the sleeve extension resting by means of its free end face 13 against the bottom 2 of the housing 8. The upper end 15 of the retaining sleeve 9 is guided through the bottom 2, and a nut 16 supported on the bottom 2 is screwed on the projecting end. When the nut is screwed tight, the intermediate plate 5 is braced axially by means of its sleeve extension 10 between the shoulder 11 of the retaining sleeve 9 and the bottom 2, thus ensuring that the end face 13 of the free end of the sleeve extension 10, which determines the distance between the intermediate plate 5 and the bottom 2, rests against the bottom 2 in a leakproof manner. If necessary, it is also possible, between the end face 13 and the bottom 2, to insert a gasket which rests on the two parts as a result of the clamping force, making a seal.

A guide tube 4 is fastened radially free of play in the retaining sleeve 9, preferably glued or hard soldered in the retaining sleeve 9. The guide tube 4 terminates approximately at the lower end face 12 of the housing 8.

Figure 2:
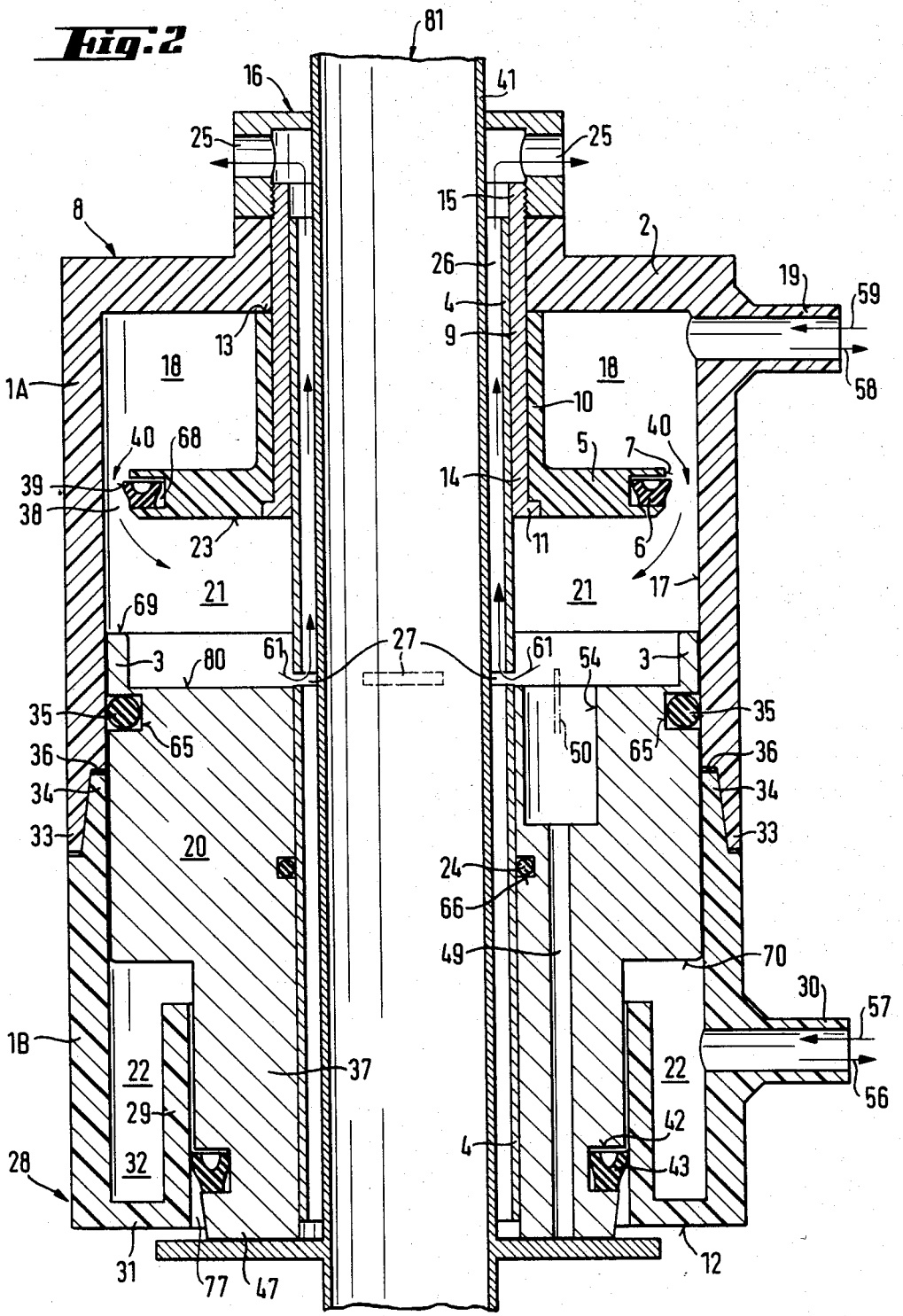
FIG. 2 shows a section according to FIG. 1, with the ram in the lower dead-center position.

A ram 20 located underneath the intermediate plate 5 divides the remaining inner space into an upper expansion chamber 21, and a lower compression chamber 22 (FIGS. 1 and 2). A sealing ring 35, preferably an O-ring, the sealing edge of which rests against the inner face 17 of the housing 8, is located in a peripheral groove 65 of the shell surface of the ram 20. A sealing ring 24, located in a circumferential groove 66, seals-off the upper expansion chamber from the guide tube 4. The ram has a portion 37 of reduced diameter, which tapers slightly conically at the free end 47, and in the end region of which a U- or grooved ring 43 is located in a peripheral groove 42. The sealing edge 44 of the grooved ring 43 projects slightly beyond the peripheral face 46 of the portion 37 to rest against the inner face 45 of the cylindrical portion 29, and, in the upper dead-center position of the ram shown in FIG. 1, it is located above the inner edge of the cylindrical portion 29, and thus opens an air-outlet channel 77. Because the free end 47 tapers conically, the air-outlet channel 77 widens in the direction of flow 60 of the outflowing air. The upper edge of the inner face 45 is advantageously provided with notches, so that the elastic sealing lip 44 can open exactly and independently of pressure, and the outgoing air can escape safely.

As may be seen best in FIG. 2, the expansion chamber 21 is connected to the pressure chamber 18 via an air-inlet orifice 38. The air-inlet orifice 38 is provided as an annular gap 40 between the housing 8 and the intermediate plate 5. In the outer edge 7 of the intermediate plate 5, there is inserted, preferably in a peripheral groove 68, a sealing ring 6 which is designed as a lip gasket, a sealing edge 39 of which projects radially into the annular gap 40.

In the edge region of its end face 80 turned towards the intermediate plate 5, the ram 20 has an annular extension 3 which is adapted to the annular gap 40 and which, in the upper dead-center position (FIG. 1) of the ram 20, penetrates into the annular gap 40. In the upper dead-center position, the gap between the annular extension 3 and the intermediate plate 5 is closed in an air-tight manner by the sealing ring 6 resting against the annular extension 3, while the gap between the inner face 17 of the housing 8 and the annular extension 3 is closed in an air-tight manner by the gasket 35 of the ram 20. Here, the sealing ring 6 acts, at the same time, as a retaining ring, since, after the annular extension 3 has been introduced, the sealing edge 39 rests against the annular extension 3 with radial pressure, and therefore also exerts a clamping force which firmly retains the ram 20 in its upper dead-center position according to FIG. 1. To produce a higher retaining force, it is advantageous to provide the inner sealing face of the annular extension 3, for example, with a slightly concave curvature.

As a result of the compressed air flowing in from the control valve 83 in the direction of the arrow 59, the pressure in the chamber 18 rises; this pressure can act on the ram 20 only via the relatively small end face 69 of the annular extension 3. When the sealing ring 6 is designed as a lip gasket, the rising pressure causes, at the same time, a higher pressing force by the sealing edge 39 on the annular extension 3, so that the clamping force is also increased. Only when the pressure on the end face 69 in the pressure chamber 18 overcomes the retaining force exerted by the sealing ring 6, is the ram 20 moved downwards. At the moment when the annular extension 3 is located underneath the sealing edge 39 of the sealing ring 6, the high pressure present in the pressure chamber 18 will act explosively on the entire end face of the ram 20 and throw the latter downwards with great force and extremely high acceleration.

As a result of the elementary active force of the compression energy released, the speed of the ram 20 is so high that essentially no additional compressed air flows after it into the pressure chamber 18 until the lower dead-center position is reached. In its lower dead-center position (FIG. 2), the ram 20 has opened, in the peripheral face of the guide tube 4, air outlet slits 27 preferably arranged in a peripheral direction, as a result of which the expansion chamber 21 is relieved virtually just as abruptly as the ram 20 is thrown downwards. The air outlet slits 27 are very narrow axially, preferably approximately 2 mm wide, but are relatively long in the peripheral direction. As a result of this design, rapid opening of the air outlet slits is possible, so that abrupt relief is guaranteed. The air flowing into the guide tube 4 in the direction of the arrow 61 is conveyed upwards in an annular air channel 26, which is formed between the inserted shaft 41 of a tool, or of a probe tube 81, and the guide tube 4, and flows out, for example, through air channels 25 provided in the nut 16. To safeguard the air channel 26 when the shaft 41 is introduced, the cap-like nut 16 screwed onto the retaining sleeve 9 is provided with a central bore corresponding to the diameter of the shaft 41, so that the nut 16 serves, at the same time, as a spacer for the inserted shaft 41 of the tool or the probe tube 81.

When the ram is thrown downwards, the grooved ring 43 penetrates into the cylindrical portion 29, its sealing edge 44 coming to rest, making a seal, on the inner face 45 of the cylindrical portion 29. As a result, the annular air-outlet channel 77, which serves to relieve the lower compression chamber 22, is closed, so that the air remaining in the lower compression chamber 22 is compressed when the pile-driver is driven downwards. This pressure rise is propagated in the direction of the arrow 56 to the control valve 83 (FIG. 4), which is reversed because of this pressure pulse and which feeds compressed air to the lower compression chamber 22 in the direction of the arrow 57. This compressed air can act in the lower compression chamber 22 only on the annular face 70 which is formed by the step to the portion 37 of the ram 20. The ram is returned to its upper dead-center position by the inflowing compressed air, with only small quantities of compressed air being needed for this. Shortly before it reaches the upper dead-center position, the sealing edge 44 of the lower grooved ring 43 moves out from the cylindrical portion 29 and opens the air-outlet channel 77 to relieve the compression chamber 22. When the ram 20 is raised, the air-outlet orifices 27 in the guide tube 4 are overrun, after which the remaining air in the expansion chamber 21 and in the pressure chamber 18 is compressed. This pressure rise is transferred to the control valve 83 (FIG. 4) in the direction of the arrow 58, and, when the switching pressure of the latter has been reached, the annular extension 3 has closed the annular gap 40 again in an airtight manner. Compressed air is now again fed to the pressure chamber 18 in the direction of the arrow 59, in order to throw the ram 20 downwards again after the clamping force exerted by the gasket 6 has been overcome.

In order to achieve complete relief of the upper expansion chamber 21 when the annular extension 3 has penetrated into the annular gap 40, in that end face 80 of the ram facing the intermediate plate 5 there is located a relief valve 48 which butts against the end face 23 of the intermediate plate 5 via a valve tappet 50 when the annular extension 3 penetrates into the annular gap 40, as a result of which the relief valve 48 is opened. Via an axial relieving bore 49 in the ram, which opens into the cylindrical portion 29, the remaining air of the upper expansion chamber 21 can escape, as a result of which it becomes possible for the annular extension 3 to penetrate completely into the annular gap 40 almost free of counter pressure, so that the ram assumes a maximum possible upper dead-center position.

To prevent premature wear of the sealing ring 35 of the ram 20, the peripheral groove 65 of the gasket 35 is placed so high that, in the lower dead-center position of the ram, it is located above the parting line 36 which results when the two cylinder halves 1A and 1B are joined together. The circumferential groove 66 for receiving the gasket 24 in the inner periphery of the ram is arranged so that, in the upper dead-center position of the ram, it is located underneath the air outlet slits 27. During operation, the sealing rings in this way are prevented from running over the air outlet slits 27 or the parting line 36.

By the constructive change in the surface subjected to the pressure in the pressure chamber 18, the "starting pressure" of the compressed-air pile-driver can be fixed as desired. Thus, for example, a design with an annular gap located radially further inwards is also possible as an air-inlet orifice, but in this case a gasket has to be provided on both sides of the introduced annular extension. The embodiment shown in FIGS. 1 and 2 has the advantage that the sealing ring 35 of the ram 20 can assume the function of a gasket which otherwise has to be provided in addition.

Likewise, by a constructive change in the cylindrical portion 29 and in the portion 37 of the ram 20 penetrating therein, it is possible to change the effective surface in the compression chamber 22. However, the annular face 70 should, in principle, be dimensioned just so that the ram 20 is guaranteed to be lifted safely into its upper dead-center position (see FIG. 1), and that the pressure to be built up in the compression chamber 22 for reversing the control valve will lessen the impact of the compressed-air pile-driver as little as possible.

Figure 3:
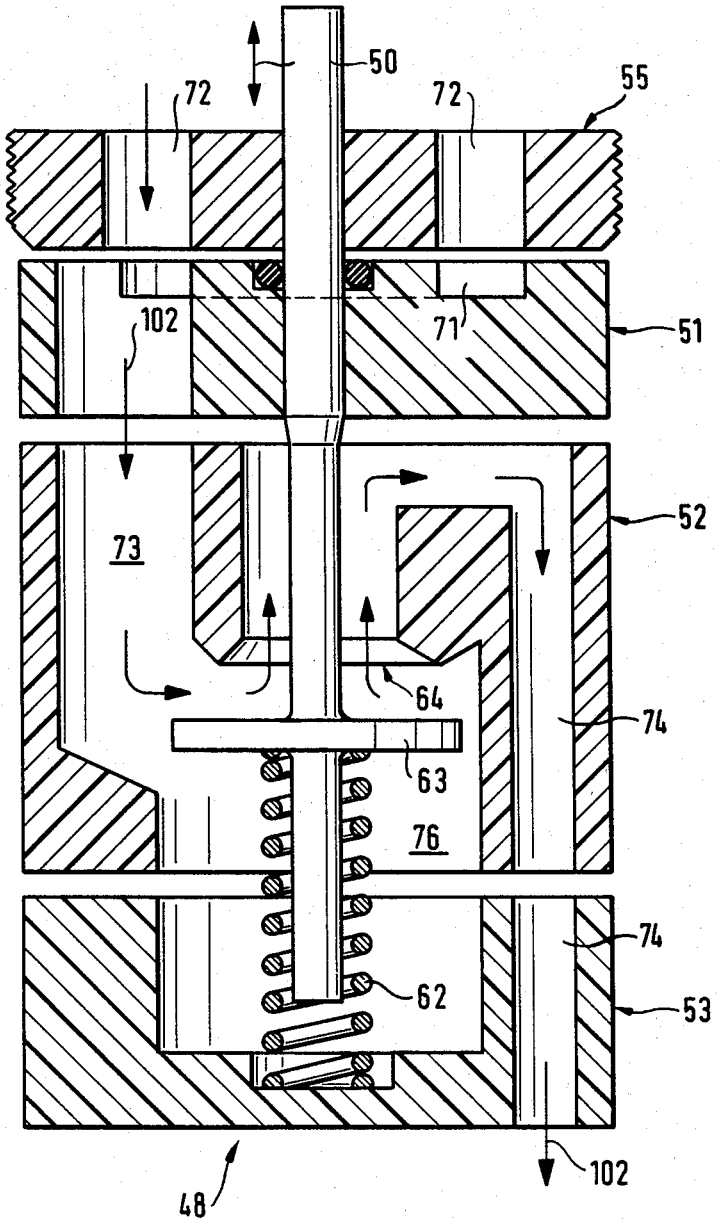
FIG. 3 shows an enlarged representation of a section through a relief valve.

The relief valve 48 illustrated on an enlarged scale in FIG. 3 is embedded in a recess 54 (FIG. 2) in that end face 80 of the ram 20 which faces the intermediate plate 5. It essentially comprises three intermediate rings 51, 52, 53 which are arranged to lie on top of one another in the recess 54, and are secured by a closure member 55 screwed into the recess. In the closure member 55 there are several axially continuous bores 72 opening into an annular channel 71 in the upper intermediate ring 51. The annular channel 71 leads via an air inlet 73 into a valve space 76 of the middle intermediate ring 52. In this valve space 76 there is a valve seat 64 with a valve disc 63 which is spring-loaded in the closing direction and which can be actuated by a valve tappet 50 projecting axially from the recess 54. When the valve tappet 50 is pressed down, the valve 63, 64 opens and the valve space 76 is connected via an outlet channel 74 to the relieving bore 49 in the ram.

The valve tappet 50 projects so far from the recess or receptacle 54 that, at the moment when the annular extension 3 penetrates into the annular gap 40, making a seal, it comes to rest against the end face 23 of the intermediate plate 5, as a result of which, when the ram 20 is lifted further, the valve tappet 50 is pushed in against the force of the valve spring 62. The valve disc 63 lifts off from the valve seat 64, as a result of which the air still remaining in the upper expansion chamber 21 can escape in the direction of the arrow 102 through the relief valve 48 and the relieving bore 49. As a result of the relief of the upper expansion chamber 21, an additional vigorous pushing of the annular extension 3 into the annular gap 40 is achieved without any reduction of the pressure in the control line to the control member; i.e. the ram 20 is brought into its highest possible upper dead-center position. Thus, adhesive forces arising between the intermediate plate 5 and the end face 80 of the ram can also be utilized as retaining forces.

As a result of the division of the relief valve into three intermediate rings, simple production of the relief valve 48 is possible; in particular, the intermediate rings and the closure member can be injection-molded from plastic, since there are no undercuts. Likewise, the intermediate plate 5 can also be injection-molded from a thermoplastic, preferably a polycarbonate, such as Makrolon (registered trademark).

Figure 4:
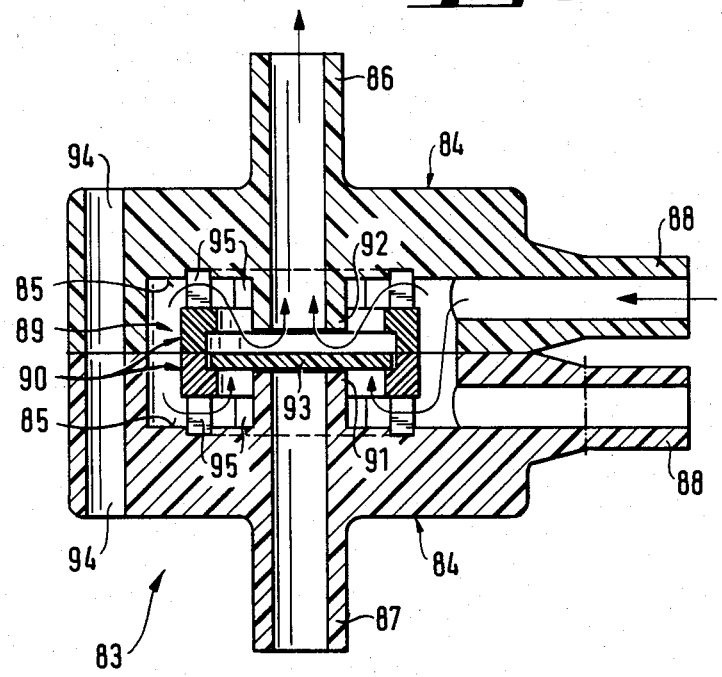
FIG. 4 shows an axial section through a control valve.
Figure 5:
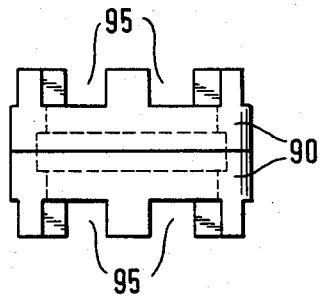
FIG. 5 shows a view of a valve insert which guides the valve plate.

The control valve 83 to be connected to the air connection pipes 19, 30 of the compressed-air pile-driver is illustrated in FIG. 4. It essentially comprises two identical halves 84, which are injection-molded from plastic, and in those end faces of which facing one another there are annular channels 85. Each annular channel 85 coaxially surrounds an axial housing connection pipe 86 and 87 respectively, and also has a radial compressed-air connection pipe 88 opening into the annular channel 85. In addition, in each half 84 there are axially continuous bores 94 which are located outside the annular channel 85. The two halves 84 rest congruently on one another, so that the annular channels 85 form an annular space 89 with housing connection pipes 86, 87 and compressed-air connection pipes 88, and the bores 94 form a continuous bore channel. Located in the annular space 89 is an annular valve insert 90 which is fixed in the bottom of the respective annular channels 85 and which coaxially surrounds the mouth of the housing connection pipes 86, 87. Mounted inside the valve insert is a valve plate 93 which interacts with the mouths, designed as valve seats 91, 92, of the housing connection pipes 86, 87. Each valve insert 90 has perforations 95 (FIG. 5) in that region thereof resting on the bottom of the annular channels 85, so that the compressed air flowing in via the compressed-air connection pipe 88 flows through the perforations 95 into the interior of the valve inserts 90, and from there flows out of the control valve through the housing connection pipes 86 or 87, which are respectively opened by the valve plate 93 (see the arrows marked). Inserted through the continuous bore channel 94 are, for example, screws, by means of which the two valve halves 84 are screwed together, making a seal.

The housing connection pipe 86 of the control valve 83 is connected, for example, to the air connection pipe 19 of the compressed-air pile-driver (FIG. 1), while the housing connection pipe 87 of the control valve 83 is connected to the air connection pipe 30 of the housing 8. The compressed-air connection pipe 88 of the upper half 84 is connected to a compressed-air source (not shown), and the lower compressed-air connection pipe 88 is separated off and/or the orifice is closed or glued. Because of the identical design of the halves 84, simple and economical production of the control valve is possible, since identical parts can be injection-molded in the same way, and only one mold is required.

By means of a pressure pulse, as is generated alternately in the pressure chamber 18 and in the annular space 32 by the ram 20 moving back and forth, the respective closed mouth of one housing connection pipe 86 is opened so as to supply the compressed air to the space assigned to the housing connection pipe 86.

Figure 6:
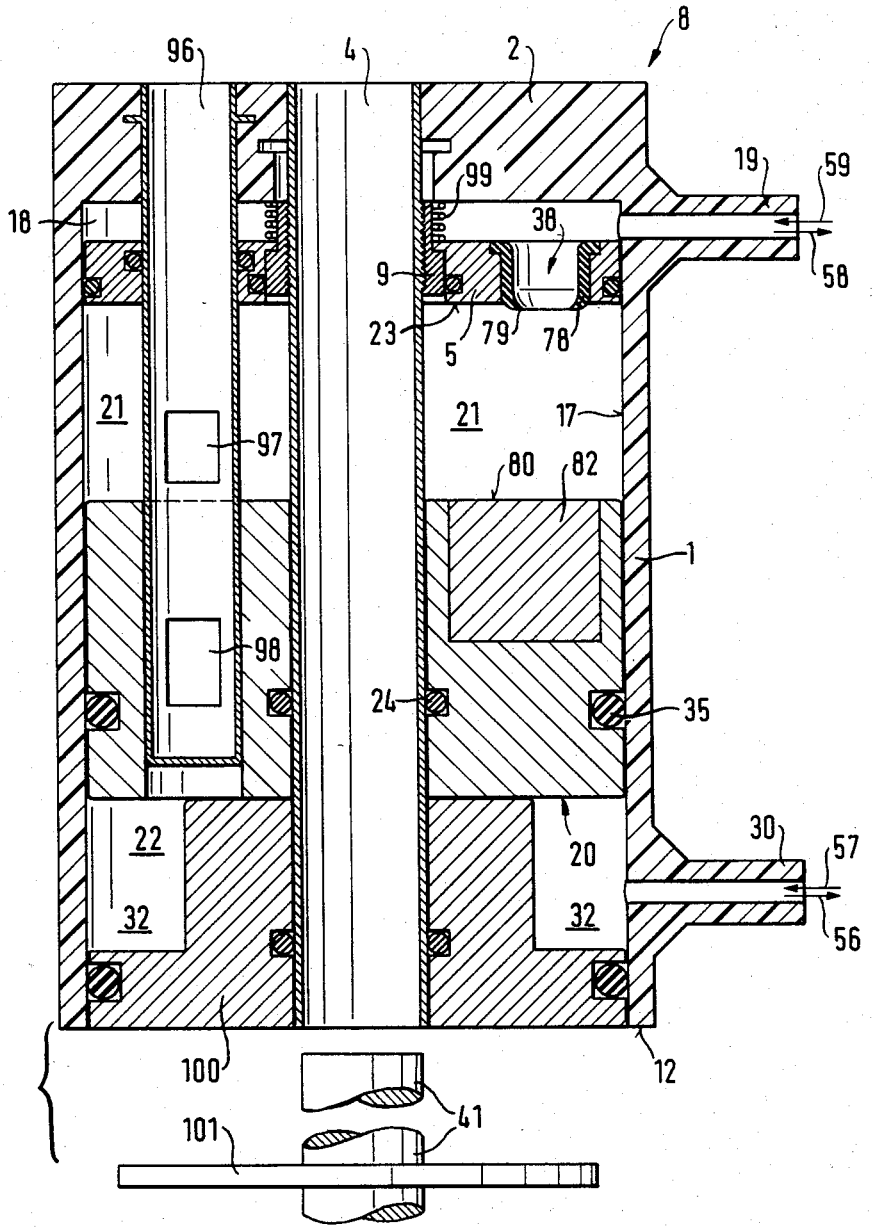
FIG. 6 shows an axial section through a compressed-air pile-driver in another embodiment.

The compressed-air pile-driver of FIG. 6 comprises a one-part cup-shaped injection-molded plastic cylinder 1, into the head or bottom 2 of which the central guide tube 4, and an air-outlet control tube 96 parallel to its axis, are injection-molded, the latter having orifices 97 and 98 corresponding to the air outlet slits 27.

The air-outlet control tube 96 passes through the intermediate plate 5 and the ram 20. The air-outlet orifices are arranged so that, in its lower dead-center position (the position marked), the ram 20 opens the air-outlet orifice 97, the air-outlet orifice 98 being closed, and in its upper dead-center position opens the air-outlet orifice 98, the air-outlet orifice 97 being closed. The outgoing air from the upper expansion chamber 21 and from the lower compression chamber 22 is conveyed away through the air-outlet control tube 96.

The intermediate plate 5, of magnetic material, is retained by means of a retaining sleeve 9 screwed onto the guide tube 4, and by means of a spring 99 located between the bottom 2 and the intermediate plate 5. The air-inlet orifice 38 is formed by at least one axial bore in the intermediate plate 5, with a cup seal 78 having a sealing edge 79 turned towards the end face 80 of the ram 20 being located in the bore.

Embedded in the end face 80 of the ram 20 is at least one magnet 82, by means of which the ram 20 is retained against the intermediate plate 5 in its upper dead-center position. In this position, the sealing edge 79 rests in an air-tight manner on the end face 80 of the ram, so that the pressure building up in the pressure chamber 18 can, in turn, only act on that face of the ram 20 which closes the air-inlet orifice 38, with the result that the effect according to the invention is provided.

In the exemplary embodiment illustrated, the housing 8 is closed by an anvil part 100 which is inserted in an air-tight manner and via which the ram 20 transmits its impact energy, for example to an impact plate 101 of a tool. The intermediate plate 5, the ram 20, and the anvil part 100 are guided in the housing 8 in an air-tight manner by sealing rings. Only the sealing-off of the air-outlet control tube 96 in the ram 20 is effected by as accurate a fit as possible. The mode of operation of the steam-operated pile-driver according to FIG. 6 corresponds essentially to the embodiment already described above (FIGS. 1 and 2).

To achieve a high retaining force, that end face of the intermediate plate 5 facing the ram 20, and that end face 80 of the ram 20 facing the former, are machined exactly planar and are preferably ground. The cup seals project slightly, preferably approximately 1/100 mm, beyond the end face 23 of the intermediate plate 5. As a result of the planar machining, adhesive forces can also be utilized as retaining forces.

To guarantee sufficient cooling when the compressed-air pile-driver is operated continuously, it is possible, for example, to arrange cooling ribs on the shell of the housing 8, or to provide a cooling device.

The air-inlet orifice 38 has a passage cross section which corresponds at least approximately to double the air-supply cross section of the air connection pipe 19. The compressed air generated by the compressor in the case of a drive power of only approximately 3 kW has a pressure of approximately 8 to 10 bars.

The design according to the invention of the compressed-air pile-driver ensures, in addition, that the return speed of the ram 20 is substantially lower than the impact speed, so that the recoils of the compressed-air pile-driver are very slight, even in the case of a high impact power.

The present invention is, of course, in no way restricted to the specific disclosure of the specification and drawings, but also encompasses any modifications within the scope of the appended claims.

What I claim is:

1. A compressed-air pile-driver, comprising in combination:

a housing;

a ram which divides the interior of said housing into an upper expansion/compression chamber including a pressure chamber and a lower expansion/-compression chamber, each of which has its own air-outlet orifice; said ram having a first end face which faces said upper expansion chamber;

a control valve connected to a source of compressed air;

a first air connection pipe connected to and opening exclusively into the pressure chamber of said upper expansion chamber;

a second air connection pipe connected to said lower expansion chamber, said first and second air connection pipes being alternately connectable to said source of compressed air via said control valve, with said air-outlet orifices of said upper and lower expansion chambers being alternately opened by said ram;

an intermediate plate which is approximately parallel to said first end face of said ram and divides off the pressure chamber in said upper expansion chamber remote from said lower expansion chamber, said first air connection pipe communicating with said pressure chamber to effect said connection with said upper expansion chamber; said intermediate plate including at least one axial orifice as an air inlet which extends from said pressure chamber to said upper expansion chamber, said at least one orifice of said intermediate plate being closed in a leak-proof manner by said ram in its upper dead-center position;

a retaining device associated with said ram and said intermediate plate for firmly axially retaining said ram in its upper dead-center position, said ram including an axial extension which, in the upper dead-center position of said ram, is located in said at least one inlet orifice of said intermediate plate to effect closing thereof; and including a sealing ring located in said intermediate plate and resting with radial pressure against said extension so as to seal off air, said extension and said sealing ring at the same time forming said retaining device for said ram, said at least one air-inlet orifice of said intermediate plate being formed by an annular gap located between the radially outer edge of said intermediate plate and said housing; said sealing ring being provided in said outer edge and having a sealing edge projecting radially into said annular air-inlet gap; said axial extension of said ram being designed as an annular extension and being located, in the upper dead-center position of said ram, in said annular air-inlet gap, and a guide tube passing centrally and in a largely air-tight manner through said housing, said intermediate plate, and said ram, said guide tube terminating approximately at the lower end face of said housing, to which it is fastened, the shaft of a tool or of a probe tube being inserted into said guide tube at a radial distance from the wall of the latter; said housing having a head on which is arranged a spacer which has a central bore corresponding to the diameter of said shaft, and which has air-channels through which outgoing air flowing between said guide tube and said shaft escapes into outside air.

2. A compressed-air pile-driver according to claim 1, in which axially very narrow air outlets are provided in said guide tube, as said air-outlet orifice of said upper expansion chamber, for sudden relief of said upper expansion chamber, said air outlets being arranged in such a way that, approximately in the lower dead-center position of said ram, they are opened by said ram.

3. A compressed-air pile-driver according to claim 2, in which said housing is made of polycarbonate resins, and comprises two parts, including a cup-shaped upper cylinder half with said head, and a lower cylinder half arranged in the same axis, with that end of said lower cylinder half which faces away from said upper cylinder half being formed by an inner coaxial cylindrical portion which is connected to said lower cylinder half via an annular bottom which forms the lower end face of said housing and which delimits an annular space which is open axially towards the interior of said housing.

4. A compressed-air pile-driver according to claim 3, in which said cylinder halves have the same diameter and the same wall thickness, and in which those ends of said cylinder halves which face one another axially overlap one another, making a seal.

5. A compressed-air pile-driver according to claim 4, in which said ram is sealed off in an air-tight manner in said housing by sealing rings respectively located in peripheral grooves of said ram.

6. A compressed-air pile-driver according to claim 5, in which said ram, remote from said first end face, is provided with a portion of reduced diameter having a grooved ring arranged in a peripheral groove in its end region, with a sealing edge of said ring projecting beyond the peripheral face of said portion to rest against the inner face of said inner coaxial cylindrical portion, the free end of said portion of reduced diameter tapering slightly conically underneath the grooved ring and forming an air-outlet channel as said air-outlet orifice of said lower expansion chamber.

7. A compressed-air pile-driver according to claim 6, in which, in the upper dead-center position of said ram, at least said sealing lip of said grooved ring is extended out beyond said inner coaxial cylindrical portion, with notches for the unimpeded outflow of air being provided in the overrun cylinder edge of said cylindrical portion.

8. A compressed-air pile-driver according to claim 7, in which said ram is provided with a relief valve having a valve tappet, and is also provided with a relieving bore closable by said relief valve, with said relief valve being opened in the upper dead-center position of said ram as a result of said valve tappet butting against said intermediate plate.

9. A compressed-air pile-driver according to claim 8, in which said control valve is located outside said housing.

10. A compressed-air pile-driver according to claim 9, in which said control valve comprises two equal halves which are injection-molded from plastic and which, in those sides thereof facing one another, are respectively provided with an annular channel and with a housing connection pipe opening into said annular channel, as well as with a compressed-air connection pipe effecting connection of said control valve to said source of compressed air.

11. A compressed-air pile-driver according to claim 10, in which, in the annular spaced formed by said annular channels, is located an injection-molded valve insert which comprises two parts and guides a valve plate which interacts with the mouths, designed as valve seats, of said housing connection pipes to effect said alternate connection of said first and second air connection pipes to said source of compressed air.

12. A compressed-air pile-driver, comprising in combination:

a housing;

a ram which divides the interior of said housing into an upper expansion/compression chamber including a pressure chamber and a lower expansion/-compression chamber, each of which has its own air-outlet orifice; said ram having a first end face which faces said upper expansion chamber;

an intermediate plate which is approximately parallel to said first end face of said ram; said intermediate plate including at least one axial orifice as an air inlet, said at least one orifice of said intermediate plate being closed in a leak-proof manner by said ram in its upper dead-center position to thereby define said pressure chamber;

a retaining device associated with said ram and said intermediate plate for firmly axially retaining said ram in its upper dead-center position;

a control valve connected to a source of compressed air;

a first air connection pipe connected to and opening exclusively into the pressure chamber of said upper expansion chamber; and a second air connection pipe connected to said lower expansion chamber, said first and second air connection pipes being alternately connectable to said source of compressed air via said control valve, with said air-outlet orifices of said upper and lower expansion chambers being alternately opened by said ram.

13. A compressed-air pile-driver in combination according to claim 12 in which a sealing ring is arranged in an outer edge of said intermediate plate.

14. A compressed-air pile-driver in combination according to claim 12 wherein said retaining device associated with said ram and said intermediate plate axially retaining said ram in its upper dead-center position are sealingly under pressure subject to variation in retaining force.

15. A compressed-air pile-driver in combination according to claim 12, in which said ram includes an axial extension which, in the upper dead-center position of said ram, is located in said at least one inlet orifice of said intermediate plate to effect closing thereof; and which includes a sealing ring located in said intermediate plate and resting with radial pressure against said extension so as to seal off air, said extension and said sealing ring at the same time forming said retaining device for said ram.

16. A compressed-air pile-driver in combination according to claim 15 in which variation in force applied by said ram retaining device is controlled by changes in operative interrelationship between said axial extension and said seailing ring.

17. A compressed-air pile-driver in combination according to claim 15, in which said at least one air-inlet orifice of said intermediate plate is formed by an annular gap located between the radially outer edge of said intermediate plate and said housing; in which said sealing ring is provided in said outer edge and has a sealing edge projecting radially into said annular air-inlet gap; and in which said axial extension of said ram is designed as an annular extension and is located, in the upper dead-center position of said ram, in said annular air-inlet gap.

18. A compressed-air pile-driver in combination according to claim 17, which includes a guide tube passing centrally and in a largely air-tight manner through said housing, said intermediate plate, and said ram, said guide tube terminating approximately at the lower end face of said housing, to which it is fastened.

* * * * *